United States Patent [19]

Bothner

[11] Patent Number: 4,619,708

[45] Date of Patent: Oct. 28, 1986

[54] FLEXIBLE SHEET CLEANING APPARATUS AND METHOD

[75] Inventor: Carl R. Bothner, Rochester, N.Y.

[73] Assignee: Eastman Kodak Company, Rochester, N.Y.

[21] Appl. No.: 683,733

[22] Filed: Dec. 19, 1984

[51] Int. Cl.[4] ..... B08B 7/00; B08B 7/02

[52] U.S. Cl. ..... 134/6; 134/9; 134/15; 134/1; 15/1.5 R; 15/256.52; 15/DIG. 5; 73/104; 73/105

[58] Field of Search ..... 134/6, 9, 15, 16, 17, 134/18, 1; 15/1.5, 308, 256.51, 100, 306 A, 256.52, 102, 159 A, DIG. 5; 355/15; 73/104, 105

[56] References Cited

U.S. PATENT DOCUMENTS

| | | | |
|---|---|---|---|
| 2,751,616 | 6/1956 | Turner, Jr. et al. | 15/77 |
| 3,117,333 | 1/1964 | Murray et al. | 15/1.5 |
| 3,470,576 | 10/1969 | Troia | 15/308 |
| 3,640,293 | 2/1972 | Freedman | 134/9 |
| 3,795,025 | 4/1974 | Sadamitsu | 15/256.52 |
| 4,032,228 | 6/1977 | Whited | 355/15 |
| 4,063,063 | 12/1977 | Funck et al. | 134/1 |
| 4,106,333 | 8/1978 | Saljé et al. | 73/105 |
| 4,111,546 | 9/1978 | Maret | 134/1 |
| 4,113,376 | 9/1978 | Rodda | 355/15 |
| 4,123,154 | 10/1978 | Fisher | 355/15 |
| 4,264,190 | 4/1981 | Tsuda et al. | 355/15 |
| 4,295,239 | 10/1981 | Myochin | 15/1.5 |
| 4,361,922 | 12/1982 | Karal | 15/256.52 |

*Primary Examiner*—Andrew H. Metz
*Assistant Examiner*—Sharon T. Cohen
*Attorney, Agent, or Firm*—Lawrence P. Kessler

[57] ABSTRACT

Apparatus and method for cleaning a flexible sheet moving along a travel path, such sheet including a leading edge extending transverse to the direction of sheet travel. A rotatable fibrous cleaning brush is located with its fibers intercepting the travel path of the moving sheet. Responsive to the approach of the leading edge of the sheet, a standing wave is generated in the fibers of the rotating brush. The standing wave results in the fibers being temporarily moved away from the travel path to enable the leading edge to pass substantially freely by such fibers. The fibers return substantially immediately into contact with the sheet after passage of the leading edge to clean the sheet including the area of the sheet adjacent to such edge.

8 Claims, 5 Drawing Figures

FLEXIBLE SHEET CLEANING APPARATUS AND METHOD

BACKGROUND OF THE INVENTION

This invention relates generally to sheet cleaning, and more particularly, to cleaning a moving flexible sheet which has a leading edge extending transverse to the direction of sheet movement.

When using materials, such as photographic or electrographic film sheets, it is desirable to ensure that the material is free of dust or debris to avoid the formation of defects. Accordingly, sections (e.g., strips or sheets) of the material are moved through a cleaning apparatus to remove any dust or debris adhering to the material. A typical cleaning apparatus includes a rotatable brush having a fibrous surface covering which is brought into brushing contact with the moving material. The fibers have a desired design configuration (i.e., size and stiffness) which, on relative movement between the fibers and the material, causes the fibers to strike adherents and remove them from the material.

While fibrous brushes have generally proven satisfactory in cleaning moving sections of material, some difficulty has been encountered in moving a material section into contact with a fibrous brush. Particularly, if the material section is flexible and the brush is moving counter to the direction of movement of the section in the area where cleaning is to be effected, contact of the brush with the leading edge of the section may damage the section. If a leading edge stiffener is provided to prevent such damage, the action of the brush on such stiffener may prevent the section from moving through the cleaning area. One way of overcoming this described problem is to move the brush away from the travel path of the moving section as the leading edge approaches the brush. However, the time required to return the brush into cleaning contact with the section after passage of its leading edge may result in a significant portion of the section passing by the brush out of cleaning contact whereby such portion is not cleaned.

SUMMARY OF THE INVENTION

This invention is directed to cleaning a flexible sheet with a fibrous brush. The flexible sheet moves along a travel path and includes a leading edge extending transverse to the direction of sheet travel. By this invention, the passage of the leading edge relative to the brush is assured and the effectiveness of cleaning of the sheet area adjacent to the leading edge is increased. A rotatable fibrous brush is located with its fibers intercepting the travel path of moving sheet. Responsive to the approach of the leading edge of the sheet, a standing wave is generated in the fibers of the rotating brush. The standing wave results in the fibers being temporarily moved away from the travel path to enable the leading edge to pass substantially freely by such fibers. The fibers return substantially immediately into contact with the sheet after passage of the leading edge to clean the sheet including the area of the sheet adjacent to such edge.

The invention, and its objects and advantages, will become more apparent in the detailed description of the preferred embodiment presented below.

BRIEF DESCRIPTION OF THE DRAWINGS

In the detailed description of the preferred embodiment of the invention, reference is made to the accompanying drawings, in which.

DESCRIPTION OF THE PREFERRED EMBODIMENT

Figures 1, 2:
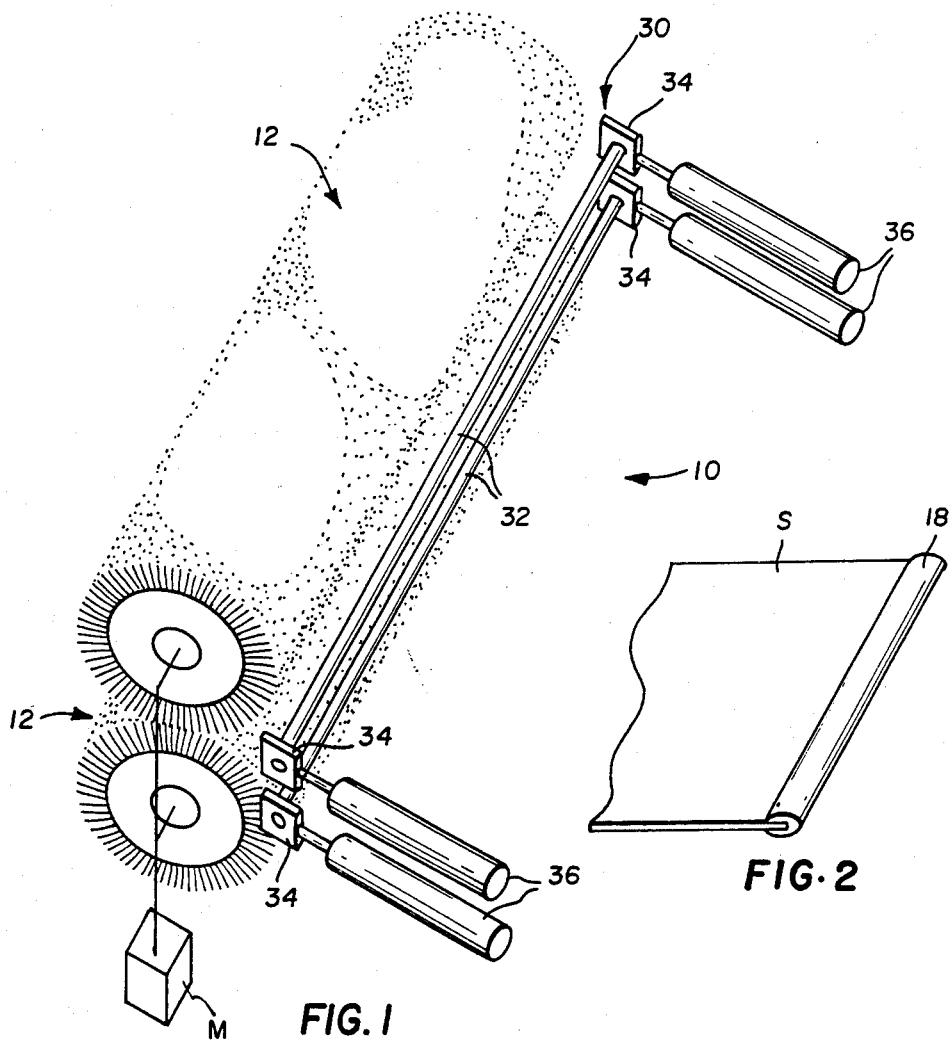
FIG. 1 is a view, in perspective, of the flexible sheet cleaning apparatus according to this invention.
FIG. 2 is a view, in perspective, of a flexible sheet having a stiffening member for the leading edge extending transverse to the direction of sheet movement.
Figure 3:
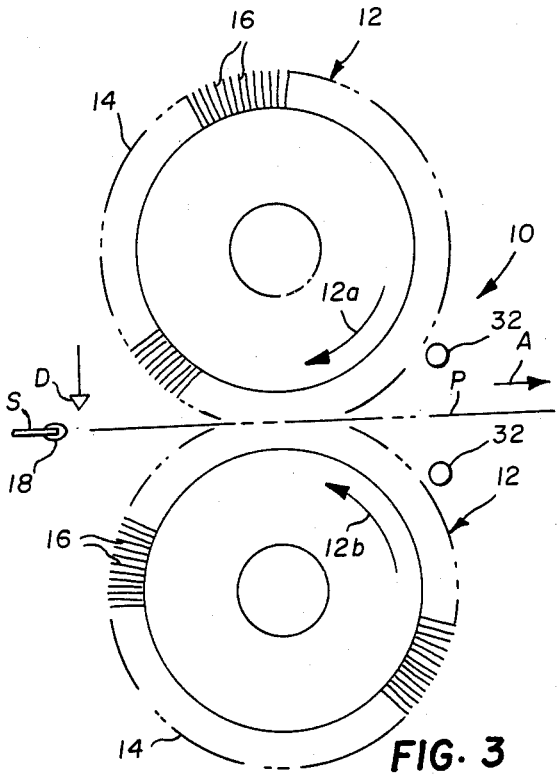
FIGS. 3 and 4 are end views showing the sheet cleaning apparatus according to this invention taken at different times in the operation thereof.

Referring now to the accompanying drawings, according to this invention an apparatus 10 for cleaning flexible sheets (e.g., sheets or strips of film), moving along a travel path, comprises a pair of substantially cylindrical brushes 12 (see FIG. 1). The brushes have fibrous surface coverings 14. For example, the coverings incorporate upstanding animal fur or polyester fibers 16 extending substantially radially from the brushes. As shown in FIG. 3, the brushes 12 are located on opposite sides of the plane of the travel path P of the flexible sheets, the longitudinal axes of the brushes being parallel and spaced respective distances from the plane less than the radial dimension to the outer periphery of the fibers 16. Thus, the fibers 16 brush the surface of a sheet moving in the travel path. The brushes 12 are supported in a suitable manner (not shown) to be rotatably driven by motor in opposite directions about their respective longitudinal axes. The direction of rotation of the respective brushes 12 (indicated by arrows 12*a*, 12*b*) is selected to move the fibers through the area of contact with the sheet in the opposite direction to the direction of movement of the sheet (indicated by arrow A).

The portion of apparatus 10 so far described is similar to prior art cleaning brush arrangements and has been determined to provide efficient removal of dust or debris adhering to material of a moving flexible sheet. Of course, other known. cleaning brush arrangements, such as a single brush or a brush having the fibers moving in the same direction as and at a different peripheral speed from the sheet are suitable for use in this invention. FIG. 2 shows an exemplary flexible sheet S having a stiffening member 18 extending transverse to the direction of sheet travel. The member 18, fixed to the leading edge of the flexible sheet, may be utilized to provide lateral stiffness to the sheet, or as a tow bar for moving the sheet along its travel path. Of course, this invention is suitable for use with flexible sheets which do not include leading edge stiffening members.

As discussed above, when the leading edge of a flexible sheet comes into engagement with the cleaning brushes, the sheet may be damaged or prevented from passing in cleaning relation with the brushes. Therefore, the cleaning apparatus 10 according to this invention further includes a mechanism 30. The mechanism 30 comprises elongated rods 32 of substantially circular crosssection supported in end bearings 34 located adjacent to the respective ends of the brushes 12. The bearings 34 hold the rods parallel to the longitudinal axes of the brushes 12 and in spaced relation to the fibers 16 of the brushes upstream of the area of engagement of the fibers with the sheet to be cleaned. Actuating members 36, such as solenoids with reciprocable armatures, are coupled to the end bearings 34.

When the leading edge (or stiffening member 18) of a moving sheet S approaches the brushes 12, it is sensed by a detector D such as a mechanically actuated switch or a photoelectric device, for example (see FIG. 3). In response to sensing the leading edge, the detector D produces a signal which is processed and used to simultaneously actuate members 36. Upon such actuation, the members 36 move the rods 32, respectively, an equal distance into intercepting relation with fibers of the brushes 12, and the fibers are bent backwards relative to brush rotation.

Figure 4:
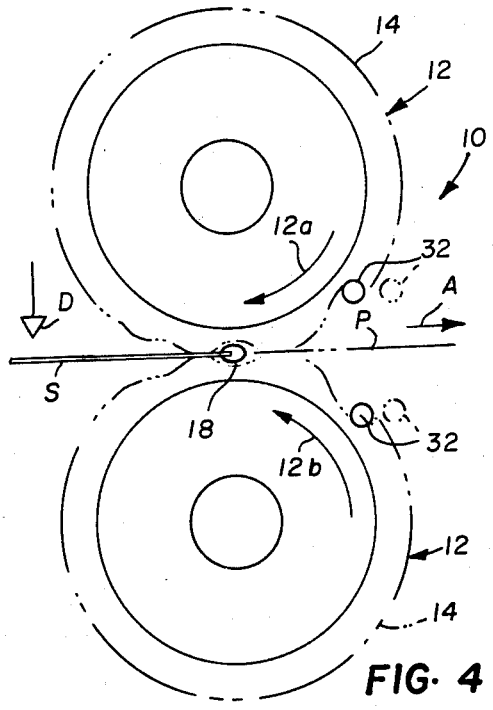
Figure 5:
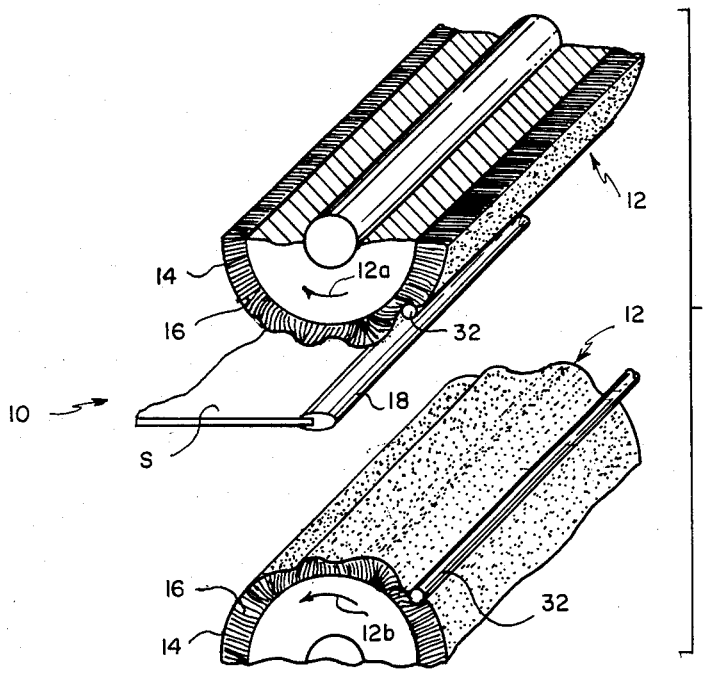
FIG. 5 is an exploded view in perspective of the cleaning apparatus according to this invention.

As the fibers 16 pass over the rods 32, they return from their bent condition in an oscillatory motion due to the fact that the fibers exhibit the characteristics of a cantilever spring. This results in a standing wave being generated in the fibrous surface coverings 14 of the brushes 12 (see FIGS. 4 and 5). That is, a portion of the fibrous surface coverings 14 extending a substantial arcuate distance downstream of the rods 32 exhibits, in cross-section, a wave-like apperance with a single frequecy mode of vibration in which the amplitude varies from place to place, is constantly zero at fixed points, and has maxima at other points. The period of the standing wave, and its amplitude, are dependent upon the internal spring and dampening characteristics of the material from which the fibers are made and the rotational speed of the roller which proportionally increases the spring constant of the fibers. The fiber material and the brush rotational speed are selected to yield a standing wave with a period and amplitude which temporarily moves the fibers away from the sheet travel path. Therefore, the leading edge of the sheet, as it passes the brushes 12, is substantially out of contact with the brush fibers, and the fibers quickly move back in contact with the sheet after passage of such leading edge. In this manner, the leading edge of the sheet passes substantially freely by the brush fibers, while cleaning of the surface area of the sheet immediately following its leading edge by the fibers is ensured.

The invention has been described in detail with particular reference to a preferred embodiment thereof, but it will be understood that variations and modifications can be effected within the spirit and scope of the invention.

I claim:

1. In an apparatus for cleaning a flexible sheet moving along a travel path, such sheet having a leading edge portion extending transverse to such travel path, said apparatus including a brush having a fibrous surface adapted to be moved in intercepting relation with such travel path to clean such moving sheet, mechanism for enabling substantial free passage of said leading edge portion by said fibrous surface comprising:

means, located adjacent to such travel path, for engaging said moving fibrous surface upstream of the area of intercept of said surface with such travel path to generate a standing wave in said surface, such wave causing said surface to temporarily move away from such travel path; and means, coupled to said engaging means, for selectively moving said engaging means into engagement with said moving fibrous surface to generate said standing wave in advance of contact of said leading edge portion with said surface thereby enabling said leading edge portion to move through said intercept area without contacting said surface and positioning said surface in contact with the portion of said sheet following said leading edge portion.

2. The invention of claim 1 wherein said selective moving means further includes means, responsive to the approach of said leading edge portion to said fibrous surface, for actuating said selective moving means to generate such standing wave.

3. Appartus for cleaning a flexible sheet moving along a travel path, such sheet having a leading edge portion extending transverse to such travel path, said cleaning apparatus comprising:

at least one substantially cylindrical brush including a plurality of radially extending fibers, said brush being located with its longitudinal axis transverse to such travel path and spaced parallel therefrom such that said fibers intercept such travel path;

means, coupled to said engaging means, for rotating said brush about its longitudinal axis, whereby said fibers are moved into brushing contact with, and clean, a flexible sheet moving along such travel path;

means, operatively associated with said brush and located adjacent to such travel path for engaging said fibers upstream of the area of intercept of said fibers with such travel path to generate a standing wave in said fibers, such wave causing said fibers to temporarily move away from such travel path; and means, operatively associated with said engaging means and responsive to approach of said leading edge portion to the area of intercept of said fibers with such travel path, for selectively moving said engaging means into engagement with said fibers to generate said standing wave in advance of contact of said leading edge portion with said fibers thereby enabling said leading edge portion to move through said intercept area without contacting said fibers and positioning said fibers in brushing contact with the portion of said sheet following said leading edge portion.

4. The invention of claim 3 wherein said fiber engaging means includes an elongated rod having a longitudinal axis parallel to the longitudinal axis of said brush.

5. The invention of claim 4 wherein said means for selectively moving said fiber engaging means includes at least one selectively actuatable solenoid having a reciprocable armature, said armature being coupled to said elongated rod, whereby upon selective activation of said solenoid reciprocation of said armature moves said rod into engagement with said fibers.

6. The invention of claim 3 wherein said cleaning apparatus comprises a pair of substantially cylindrical brushes located on opposite sides of such travel path, and wherein said rotating means rotates said brushes in respective directions such that said fibers of each brush, on brushing contact with a sheet, move opposite to the direction of movement of such sheet.

7. Method of cleaning a moving flexible sheet, having a leading edge portion, using a brush for brushing the surface of the moving sheet, said method comprising the steps of:

sensing the approach of a leading edge portion to the brush; and generating a standing wave in the bristles of the brush to temporarily deflect the bristles around the leading edge portion and to return such bristles into cleaning contact with the portion of the sheet web immediately adjacent to the leading edge portion.

8. The invention of claim 7 further including the steps of:

generating such standing wave in response to such sensed approach of the leading edge portion.

* * * * *